US006491966B1

(12) United States Patent
Lisec

(10) Patent No.: US 6,491,966 B1
(45) Date of Patent: Dec. 10, 2002

(54) PROCESS FOR APPLICATION OF SPACERS FOR INSULATING GLASS PANES OF THERMOPLASTIC MATERIAL

(76) Inventor: Peter Lisec, Bahnhofstrass 34, A-3363 Amstetten-Hausmening (AT)

( * ) Notice: Subject to any disclaimer, the term of this patent is extended or adjusted under 35 U.S.C. 154(b) by 0 days.

(21) Appl. No.: 09/434,115

(22) Filed: Nov. 5, 1999

(30) Foreign Application Priority Data

Nov. 6, 1998 (AT) ..... 1846/98

(51) Int. Cl.[7] ..... B05D 1/26; B05D 5/00

(52) U.S. Cl. ..... 427/8; 427/165; 427/284; 427/286; 427/287

(58) Field of Search ..... 427/162, 164, 427/165, 168, 207.1, 208.2, 284, 286, 287, 421, 422, 424, 8; 118/302, 317, 323

(56) References Cited

U.S. PATENT DOCUMENTS

| | | | | |
|---|---|---|---|---|
| 4,922,852 A | | 5/1990 | Price | |
| 5,136,974 A | * | 8/1992 | Lisec | 118/673 |
| 5,462,199 A | * | 10/1995 | Lenhardt | 222/54 |
| 5,762,738 A | * | 6/1998 | Lafond | 156/107 |
| 5,803,943 A | * | 9/1998 | Parsons | 62/269 |
| 6,054,001 A | * | 4/2000 | Swanson et al. | 156/108 |
| 6,180,708 B1 | * | 1/2001 | Chu | 524/450 |

FOREIGN PATENT DOCUMENTS

| | | |
|---|---|---|
| DE | 37 26 274 | 9/1991 |
| DE | 196 32 063 | 3/1998 |
| EP | 0 124 188 | 11/1984 |
| EP | 0 176 388 | 4/1986 |

* cited by examiner

*Primary Examiner*—Fred J. Parker
(74) *Attorney, Agent, or Firm*—Young & Thompson

(57) ABSTRACT

When a thermoplastic spacer is applied to a glass pane in the production of insulating glass panes, the nozzle from which the plastic with the desired cross sectional shape is extruded along the edge of the glass pane. The speed with which the plastic is applied along the edge of the glass pane is chosen depending on the temperature of the plastic. Here, for a stipulated temperature setpoint the speed with which the plastic is applied along the edge of the glass pane is stipulated. If the temperature increases, the speed is increased; conversely, when the temperature drops below the setpoint, the speed with which the plastic is applied along the edge of the glass pane is reduced. This ensures that the correct amount of thermoplastic is always extruded onto the glass pane and a spacer with a uniform cross section is obtained.

13 Claims, No Drawings

PROCESS FOR APPLICATION OF SPACERS FOR INSULATING GLASS PANES OF THERMOPLASTIC MATERIAL

BACKGROUND OF THE INVENTION

Field of the Invention

The invention relates to a process for applying a spacer of thermoplastic to a glass pane in the course of producing insulated glass panes in which thermoplastic is applied to a glass pane along its edge.

DESCRIPTION OF THE RELATED ART

In addition to spacers of metal, generally hollow aluminum sections, producing insulating glass with plastic spacers has been known for a long time, there being essentially two embodiments.

One embodiment ("swiggle strip") uses a prefabricated strand of butyl rubber which, withdrawn from a storage reel, is pressed onto one glass pane of an insulating glass pane (DE 37 26 274 C).

Another process ("Biver" process) calls for applying a setting plastic to the glass pane from a nozzle which is moved along the edge of the glass pane (EP 0 176 388 A).

Finally, recently it has been repeatedly proposed that thermoplastic spacers be used, generally proceeding such that the thermoplastic is extruded directly onto one glass pane from an application nozzle as a strand with the desired cross sectional shape—generally rectangular (DE 196 32 063 C). In the latter process for producing spacers for insulating glass panes, when the strand which is designed to be used as the spacer is applied, due to the use of thermoplastic, problems arise to the extent that the accurate control of the amount of thermoplastic to be applied is not easily possible. In one known process the attempt is made to use the amount to be applied for accurate proportioning by combination of a plunger pump for delivery of thermoplastic to the nozzle and a gear pump which is provided on the nozzle.

The latter measure (combination plunger pump-gear pump) is not able to ensure under all circumstances that exactly the correct amount of thermoplastic is applied to the glass pane per unit of length of spacer which is to be applied from the nozzle.

The reason for this is that the viscosity, therefore the flow behavior of the thermoplastic, is extremely dependent on temperature. Regardless of the circumstance that insulated lines are used for transport of the thermoplastic heated to a temperature which corresponds to the desired flow behavior to the nozzle, major problems occur when the temperature fluctuates.

Control of the delivery pressure depending on quantity and viscosity in the processing of thermoplastic is known from AT 399 497 B, EP 0 124 188 A and U.S. Pat. No. 4 922 852 A.

SUMMARY OF THE INVENTION

The object of the invention is to devise a process of the initially mentioned type with which it is ensured as independently of temperature fluctuations as possible that the correct amount of thermoplastic is applied at the time to form a spacer for insulating glass panes.

DESCRIPTION OF THE PREFERRED EMBODIMENTS

This object is achieved as claimed in the invention in that the temperature of the thermoplastic is acquired at least in the area of the location at which the plastic is applied to the glass pane, that the speed with which the plastic is applied along the edge of the glass pane is increased when the temperature of the thermoplastic acquired in the area of the location at which the plastic is applied to the glass pane is increased above a given setpoint, and that the speed with which the plastic is applied along the edge of the glass pane is reduced when the temperature which is acquired in the area of the location at which the plastic is applied to the glass pane drops below a given setpoint.

Because of the fact that in the invention the temperature of the thermoplastic is measured as it emerges from the nozzle, therefore at the location at which the plastic is applied to the glass pane and the relative speed between the nozzle and the glass pane is changed as a function of the ascertained temperature and thus depending on the flow behavior of the thermoplastic as it emerges from the nozzle, it is ensured that even when the temperature changes the correct amount of thermoplastic is applied to the glass pane per unit of length as the spacer so that a cross sectional shape of the thermoplastic spacer which is uniform over the entire length of the spacer is ensured.

The invention takes into account the circumstance that when the pressure generated by the conveyor means (plunger pump, gear pump or combination of pumps) remains the same, the amount of thermoplastic emerging from the nozzle per unit of time depends on its temperature. Thus temperature changes of only a few degrees have a noticeable effect on the amount of thermoplastic which emerges from the nozzle per unit of time.

In one embodiment of the process as claimed in the invention it proceeds such that the pressure with which the thermoplastic is delivered to the location at which the plastic is applied to the glass pane is kept constant at least in one area of stipulated deviations of the temperature from the stipulated temperature.

In practical execution of the process as claimed in the invention it is possible to change the delivery pressure with which the thermoplastic emerges from the nozzle for greater changes in the temperature of the thermoplastic. Here, within the framework of the invention the process takes place such that the conveyor pressure is increased when the temperature of the thermoplastic drops below a stipulated boundary value in the area of the location at which the plastic is applied to the glass pane, or that the delivery pressure is reduced when the temperature of the thermoplastic in the area of the location at which the plastic is applied to the glass pane, rises above a stipulated boundary value.

By means of the latter two measures, the extent of the temperature-dependent changes of the speed with which the plastic is applied along the edge of the glass pane is kept small.

The control of speed as claimed in the invention with which the plastic is applied to the glass pane is especially accurate when as claimed in the invention the temperature of the thermoplastic is measured directly at the location at which the plastic is applied to the glass pane.

Even if it is enough in practice when the temperature of the thermoplastic is measured directly at the nozzle, it is advantageous in practice when according to one proposal of the invention the temperature of the thermoplastic is acquired at least at one other location at a distance from the location at which the plastic is applied to the glass pane, especially in the area of the flow path of the plastic to the nozzle. The measure of the temperature of the thermoplastic at least at one location of the delivery line at a distance from the nozzle makes it possible to prepare the control of the relative speed between the nozzle, therefore the location at which the plastic is applied to the glass pane, and the glass pane for an incipient change of the temperature of the thermoplastic so to speak so that the actual change of the relative speed between the nozzle and the glass pane can be executed promptly and in the correct direction (increase or decrease of the relative speed).

When the temperature of the thermoplastic is measured not only directly at the nozzle mouth, but also at a distance from the nozzle mouth at least at one location of the delivery line which supplies the thermoplastic to the nozzle, there is for example also the possibility of controlling the relative speed between the nozzle and the glass pane, therefore the speed with which the nozzle moves along the edge of the glass pane to which a thermoplastic spacer is to be applied, depending on the average of these at least two ascertained temperatures.

To execute the process as claimed in the invention it is irrelevant whether the nozzle from which the plastic is applied to the glass pane moves along the edge of a stationary glass pane or whether the glass pane is moved along a stationary nozzle. Combinations of these two possibilities of effecting relative motion between the nozzle and glass pane are also conceivable. Thus for example it can be imagined that for part of the edges of the glass pane (generally the edges which are horizontal when the glass pane is standing perpendicularly) the glass pane is moved along the stationary nozzle, and that the nozzle is moved along the perpendicular edges.

By means of the measures proposed as claimed in the invention which can if necessary be developed by the possible embodiments of the invention which are named in the dependent claims is it ensured that the amount of thermoplastic applied per unit of length of thermoplastic spacer to be produced is kept constant even when the temperature fluctuates.

Here it is advantageous that changes of the delivery pressure in the normal case are not necessary so that the delivery pressure can be kept constant; this is more easily possible than keeping the temperature constant since this depends on many parameters, which include for example the ambient temperature and the temperature of the glass pane.

The process as claimed in the invention can be further equipped as follows.

Not only the temperature, but also the backpressure at the nozzle is measured and the result of pressure measurement is incorporated into the path control of the nozzle (control of the relative speed between the nozzle and glass pane). The reason for this measure is that the thermoplastic mass which forms the spacer frame can have different consistency even if it is taken from a single skein. This can be the case for example when mixing is not entirely homogenous and in the skein there are for example proportions of the thermoplastic mass with a higher proportion of filler.

In particular when the backpressure increases (which is caused by more of the thermoplastic mass being delivered to the nozzle than can emerge from the nozzle) the path control is changed for the purposes of increasing the relative speed between the nozzle and glass pane. At the same time the temperature control, therefore the heating of the thermoplastic can be adapted and in this case the heating output is increased in order to heat the plastic to a higher temperature. Feasibly when the backpressure on the nozzle drops (this occurs when the thermoplastic emerges "too easily" from the nozzle), the path control is changed for purposes of reducing the relative speed between the nozzle and the glass pane is changed. In this case the temperature of the thermoplastic can also be reduced by choking the heating.

In summary, one preferred embodiment of the process as claimed in the invention can be described as follows.

When a thermoplastic spacer is applied to a glass pane in the production of insulating glass panes, the nozzle from which the thermoplastic with the desired cross sectional shape is extruded onto a glass pane is moved along the edge of the glass pane. The speed with which the nozzle is moved along the edge of the glass pane is chosen depending on the temperature of the plastic. Here, for a stipulated temperature setpoint the speed with which the nozzle moves along the edge of the glass pane is stipulated. If the temperature changes up, the speed is increased, conversely when the temperature drops below the setpoint, the speed with which the nozzle is moved along the edge of the glass pane is reduced. This ensures that the correct amount of thermoplastic is always extruded onto the glass pane and a spacer with a uniform cross section is obtained.

What is claimed is:

1. Process for applying a spacer of thermoplastic to a glass pane in the course of producing insulated glass panes comprising the steps of:

applying thermoplastic through an applicator to a glass pane along an edge of the glass pane by moving the applicator relative to the glass pane;

measuring a temperature of the thermoplastic as the thermoplastic emerges from the applicator;

increasing a speed of the movement of the applicator relative to the glass pane if the measured temperature of the thermoplastic exceeds a predetermined setpoint; and decreasing the speed of the movement of the applicator relative to the glass pane if the measured temperature of the thermoplastic drops below the predetermined setpoint.

2. Process as claimed in claim 1, wherein a pressure with which the thermoplastic is delivered to the glass pane is kept constant within a predetermined range of the measured temperature encompassing the predetermined setpoint.

3. Process as claimed in claim 2, comprising the further step of increasing the pressure with which the thermoplastic is delivered to the glass pane if the measured temperature of the thermoplastic drops below the predetermined range.

4. Process as claimed in claim 2, comprising the further step of decreasing the pressure with which the thermoplastic is delivered to the glass pane if the measured temperature of the thermoplastic rises above the predetermined range.

5. Process as claimed in claim 1, wherein the temperature of the thermoplastic is measured directly at the location at which the thermoplastic is applied to the glass pane.

6. Process as claimed in claim 1, further comprising the step of measuring a second temperature of the thermoplastic at at least one location in a supply path for the thermoplastic prior to the applicator.

7. Process as claimed in claim 2, wherein the temperature of the thermoplastic is measured directly at the location at which the thermoplastic is applied to the glass pane.

8. Process as claimed in claim 3, wherein the temperature of the thermoplastic is measured directly at the location at which the thermoplastic is applied to the glass pane.

9. Process as claimed in claim 4, wherein the temperature of the thermoplastic is measured directly at the location at which the thermoplastic is applied to the glass pane.

10. Process as claimed in claim 2, further comprising the step of measuring a second temperature of the thermoplastic at at least one location in a supply path for the thermoplastic prior to the applicator.

11. Process as claimed in claim 3, further comprising the step of measuring a second temperature of the thermoplastic at at least one location in a supply path for the thermoplastic prior to the applicator.

12. Process as claimed in claim 4, further comprising the step of measuring a second temperature of the thermoplastic at at least one location in a supply path for the thermoplastic prior to the applicator.

13. Process as claimed in claim 5, further comprising the step of measuring a second temperature of the thermoplastic at at least one location in a supply path for the thermoplastic prior to the applicator.

* * * * *